United States Patent [19]

Brandt

[11] Patent Number: 4,640,212

[45] Date of Patent: Feb. 3, 1987

[54] ROPE AND A MOORING DEVICE, PARTICULARLY FOR CLAMPING GOODS MOORING SHIPS AND ANCHORING FLOATING LANDING STAGES, BUOYS, NAVIGATION MARKS AND THE LIKE

[75] Inventor: Bertil Brandt, Paris, France

[73] Assignee: Socared S.A., Geneva, Switzerland

[21] Appl. No.: 162,462

[22] Filed: Jun. 24, 1980

Related U.S. Application Data

[63] Continuation of Ser. No. 917,757, Jun. 21, 1978, abandoned.

[51] Int. Cl.[4] ..... B63B 21/00

[52] U.S. Cl. ..... 114/230; 87/7

[58] Field of Search ..... 114/230, 243, 293, 242, 114/253, 263, 269; 9/8 R, 8 P; 57/210, 225, 230; 87/7, 8; 280/480; 441/3

[56] References Cited

U.S. PATENT DOCUMENTS

| | | | |
|---|---|---|---|
| 2,101,003 | 11/1937 | Fox | 57/230 |
| 2,865,978 | 12/1958 | Modrey | 57/225 |
| 3,206,543 | 9/1965 | Gilmore | 280/480 |
| 3,442,245 | 5/1969 | Christians et al. | 114/230 |
| 3,950,806 | 4/1976 | Puchois | 9/8 R |

OTHER PUBLICATIONS

"Goldbergs"; 1973 Marine Equipment Catalogue p. 3.

*Primary Examiner*—Galen L. Barefoot

*Assistant Examiner*—Jesûs D. Sotelo

*Attorney, Agent, or Firm*—Beveridge, DeGrandi & Weilacher

[57] ABSTRACT

An elastomer rope is disclosed which is useful among other things for clamping goods to the platform of a load carrying vehicle and for mooring boats, floating landing stages, buoys, navigation marks and the like. A mooring device is also shown for anchoring floating landing stages, buoys, navigation marks and the like. The elastomer rope has the property of becoming progressively ever stiffer at increasing elongation and consists of a core of an elastomeric material, a reinforcement wound helically about the core and consisting of a material considerably less elongatable than the elastomeric material of the core, and an outer covering layer of elastomeric material. The progressivity is attained in that the reinforcement is helically wound about the core at a reinforcement angle of 50°-65° between the longitudinal axis of the core and the reinforcement projected at right angles thereto. The mooring device has a floating body connected to a bottom fastening with the aid of an elastic element which is under tensile prestress. The floating body is rigidly connected to a rigid tubular arm which extends downwards from the floating body. The elastic element extends from below into the tubular arm and is fixed to the upper end thereof. The elastic element is such as to become progressively ever more rigid at increasing elongation and consists of an elastomer rope of the above design.

3 Claims, 10 Drawing Figures

Diameter (mm)
20
10
0
100
200
Elongation %
30
32
34
36
38
α=65°
α=45°
α=55°
α=60°

Load kgf
400
300
200
100
0
50
100
Rope elongation %
α=45°
α=50°
α=55°
α=60°
40
42
44
46

ROPE AND A MOORING DEVICE, PARTICULARLY FOR CLAMPING GOODS MOORING SHIPS AND ANCHORING FLOATING LANDING STAGES, BUOYS, NAVIGATION MARKS AND THE LIKE

REFERENCE TO A RELATED APPLICATION

This application is a continuation of copending application Ser. No. 917,757, filed June 21, 1978, now abandoned, which is relied on herein.

The use of elastomer cords or ropes as substitutes for conventional ropes, such as for securing goods to the platform of a load carrying vehicle and for mooring ships, has become known in many connections. In these and other uses the high ductility of the elastomers has been exploited to provide an elastic fixation and mooring, respectively. A problem encountered in this connection is, however, that, on the one hand, so high a ductility as possible of the elastomer cord or rope is desired, and, on the other hand, one must still see to it that the tensile stress caused by the elasticity of the elastomer cord or rope becomes sufficient for the purpose contemplated. It is true that the additional pull required to obtain for example a further 10% elongation, increases progressively when the elongation of the elastomer cord or rope approaches the elongation at break, but it would be desirable, in the above-mentioned uses of elastomer cords or ropes, to have an elastomer cord or rope in which this progressively is more pronounced and which will thus become progressively ever more rigid at increasing elongation.

An example of a use where such an elastomer cord or rope would involve a great improvement, are mooring devices for ships and boats, such as pleasure craft. In marinas one has thus often placed a series of buoys at a large distance from the landing stage, and these buoys are connected to buoy stones or other permanent fastenings on the sea-bottom. As a rule there extends between the buoy and the buoy stone a chain the length of which must, however, be so adapted as to be in considerable excess of the vertical distance between the buoy and the buoy stone in order that water level variations shall be taken into account. The buoys must be placed rather far from the landing stage since the angle between the water surface and the rope which is directly or indirectly connected to the buoy stone, must be rather small in order that unusually high water levels shall not result in the boat being pulled under the water surface. To counteract this disadvantage to a certain extent one has often placed a separate suspension buoy near the ship and hung on this buoy the end of a hawser which in turn is anchored to a buoy stone or the like at a larger distance from the landing stage than the suspension buoy. However, there is the disadvantage in that this hawser must be of unnecessarily great length and can therefore be of inconvenience when it lies freely on the bottom of the marina basin. If it were possible to replace the hawser fixed to a buoy stone by an elastomer cord or rope which has the above-mentioned progressivity so that said cord or rope becomes progressively ever more rigid the more it is elongated one could dispense with long free hawser lengths on the bottom of the marina basin, and at the same time said elastomer cord or rope could be elongated to the requisite extent until the necessary pull has been reached. Another case where problems are encountered is in light-weight landing stages, i.e. floating landing stages which as a rule suffer from the drawback of being unstable, implying that if a person walks on one side of the landing stage this side will sink heavily, the landing stage tending to float away in the opposite direction. The only thing that precludes this tendency of the floating landing stage to float away are the floating bodies placed on the same side as said person. The anchorages of the landing stage to the bottom and possibly also to the shore have no direct effect on the stability of the landing stage. To obtain good stability one has therefore often procured heavy, bulky and as a consequence, expensive landing stages, usually of concrete, or one has been forced to stabilize the light-weight landing stages by loading the floating bodies thereof with heavy material so that these floating landing stages will also become considerably heavier than they would need to be. Another disadvantage of the prior art floating landing stages is that they mostly have heavy chains which project obliquely downwardly and outwardly from the stages and at the ends of which weights in the form of for instance concrete blocks are fixed to anchor the chains to the bottom. It is true that such chains have a certain sag or slack, but the chains can nonetheless be inconvenient, particularly when boats of relatively great draft shall berth at the landing stage.

Similar problems are encountered with the present way of anchoring buoys, where, as a rule, use is made of a chain between the buoy and the buoy stone. The chain is so adjusted that the length thereof is in considerable excess of the vertical distance between the buoy and the buoy stone. This way of anchoring buoys is disadvantageous firstly in that heavy and unnecessarily long chains need to be used, secondly in that the long chains permit the buoy to drift a considerable distance before it is decelerated, and thirdly in that this possibility of drifting makes it necessary to occupy an unnecessarily large manoeuvering space for each boat when mooring the boat to the buoy.

Similar problems are also encountered upon anchoring of navigation marks and marking buoys, such as buoys for marking closed borehole valves which upstand from the bottom, particularly in fishing areas. In the latter case the marking buoys may be anchored with 80–100 m long chains. Chains of this length are heavy and therefore necessitate very large buoys, and what is more the chains are exposed to very high corrosion and wear, particularly because of the heave of the sea which may amount to 10–15 m. The difficult circumstances make it necessary frequently to change the chains of navigation marks and marking buoys.

Another use of elastic ropes is the lashing of the load on ships and load carrying vehicles. A rope which becomes progressively ever more rigid at increasing elongation would be of great advantage also in such a case.

When mooring floating landing stages, buoys, navigation marks and the like as well as when lashing loads one could considerably reduce the problems experienced at present by making use of an elastomer rope (or cord) of adjusted progressivity, that is a rope which becomes progressively ever more rigid at increasing elongation.

The present invention provides a rope (or cord) of elastomeric material which satisfies the above-mentioned objects and which can be exploited for solving the problems encountered e.g. on mooring of boats, floating landing stages, buoys and navigation marks. The elastomer rope according to the present invention comprises a core of elastomeric material, a fibre reinforcement disposed around said core, and an outer covering layer of elastomeric material, the elastomeric material in said core and said covering layer preferably being synthetic rubber. The elastomer rope according to the present invention is characterized in that the fibre reinforcement which consists of a material considerably less elongatable than the elastomeric material of the core, is helically wound about the core with a reinforcement angle of 50°–65° between the longitudinal axis of the rope and the reinforcement projected at right angles thereto. The fibre reinforcement preferably consists of cord fillaments or strips, especially of polyester material. If the fibre reinforcement comprises two layers, the best result and the least tendency of rotation of the rope upon elongation are attained if the two reinforcing layers are helically wound in opposite directions with the same reinforcement angle.

The invention is based on the understanding that the change of diameter of a core of elastomeric material, such as rubber, is different from the change in diameter of a reinforcement helically wound about the core when the core and the helical reinforcement are axially elongated, and that the differences between the changes in diameter of the core and the reinforcement can be exploited in order to provide the above-mentioned desired progressivity of the force or load necessary to produce a definite additional further elongation. The decrease in diameter of the core on increasing longitudinal elongation of the core is determined by the properties of the elastomeric material, particularly the properties of elasticity thereof, while the decrease in diameter of the helically coiled reinforcement is determined to the major part by the reinforcement angle, i.e. the angle between the longitudinal axis of the core and the reinforcement projected at right angles thereto. By varying the reinforcement angle, the reinforcement can be caused to reduce its diameter more or less rapidly in relation to the decrease in diameter of the core. When the decrease in diameter of the reinforcement tends to be larger than that of the core the effect will be that the reinforcement squeezes the core which will not, however, be compressed to a greater extent. The resulting effect is that the core in such a case will counteract the decrease in diameter of the helix of the reinforcement, whereby the reinforcement will have an ever increasing effect on the necessary pull for producing the contemplated additional elongation.

FR-PS No. 955,262 describes an endless loop or strap which consists either of an entirely interlaced structure formed by one and the same group of fibres or threads having been interlaced turn after turn outside each other to form a multilayer structure in which the inner interlaced layers form a core, or of a core of plastics, rubber or like material with a surrounding interlacing consisting of fibres or threads, the outer side of said interlacing being optionally covered by an outer sheath of plastics or rubber material. The core or plastics, rubber or like material can be solid or hollow. This French patent specification does not, however, teach the above-mentioned basic principle of the present invention, i.e. one has not realized the benefit of nor exploited the various diameter changes of the core of elastomeric material and the reinforcement of fibre material wound or interlaced about said core; in the examples illustrated one has made use of reinforcement angles of 30°, 38° and 42° between the longitudinal axis of the core and the reinforcement projected at right angles thereto, which results in that the reinforcement from the very beginning tends to reduce its diameter more than the decrease in diameter will amount to in the core at the same elongation. This state of affairs is discussed more in detail in the following description of the present invention.

When an elastomer rope according to the present invention is utilized as a mooring device the elastomer rope can be attached to a fastening and the end of the rope opposite to the fastening can optionally be attached to an extension manufactured from conventional rope.

The invention also concerns a mooring device adapted for anchoring of floating landing stages, buoys, navigation marks and the like, comprising at least one floating body of relatively great displacement and means connecting the floating body to one or more stationary anchorages placed on the sea bottom. Characteristic of the mooring device according to the invention is that said means include a rigid tubular arm which is rigidly connected to the floating body and which projects downwardly from said body, an elastic element or rope, preferably an elastomer rope of the above nature, being connected to the stationary anchorage or anchorages and extending into and through said tubular arm and being attached to the upper end thereof. The elastic element is preferably constantly stretched, i.e. the elastic element is stretched or elongated to such an extent that a certain elastic elongation remains also at the lowest conceivable water level. The described mooring device provides an essential improvement of the stability of the floating landing stages, buoys, navigation marks and the like, and this stability is further improved if the length by which the tubular arm extends under water considerably exceeds the length of the elastic element from the anchorage to the lower end of the arm. The tubular arm functions as a moment arm which counteracts inclination and overkeeling.

To prevent unnecessary wear of the elastic element it is preferred that the lower end of the tubular arm is flared so as not to chafe with a sharp edge against the elastic element.

The elastic element can certainly be directly connected to said anchorages or buoy stones, but in certain positions it may be advantageous to connect the elastic element to these anchorages mainly via inextensible ropes, wires, hawsers, chains or the like.

When the mooring device is utilized for mooring landing stages a particularly favourable stability is obtained if two floating bodies of the landing stage are placed on either side of said tubular arm and rigidly connected to said arm via stays. One of these stays can serve as part of the gang way of the landing stage.

To facilitate adjustment of floating landing stages having a mooring device according to the invention it is advantageous to have the elastic element directly or indirectly accessible from the upper end of the tubular arm so that the elastic element can be stretched by a person standing on the landing stage or in a boat laterally of a buoy.

The invention will be described in greater detail hereinbelow with reference to the accompanying drawings in which FIG. 1 shows an embodiment of a rope according to the present invention;

Figure 1:
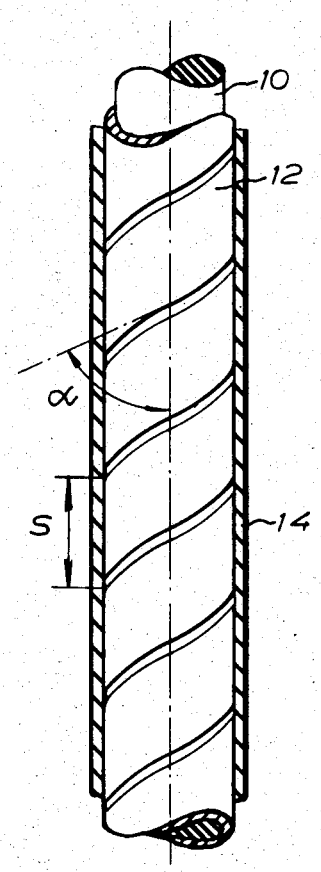

As will appear from FIG. 1 the rope according to the present invention has a core 10 of a suitable elastomeric material, such as EPDM rubber. A polyester cord strip 12 is helically wound about the core 10, the winding or reinforcement angle being designated $\alpha$ and being the angle that the longitudinal axis of the core makes with the reinforcement projected at right angles thereto. The pitch of the helically wound polyester reinforcement is designated s. An outer sheath 14 of elastomeric material is disposed on the outer side of the helically extending polyester strip. Said outer sheath is preferably also formed by an elastomeric material which is weatherproof.

Figure 5:
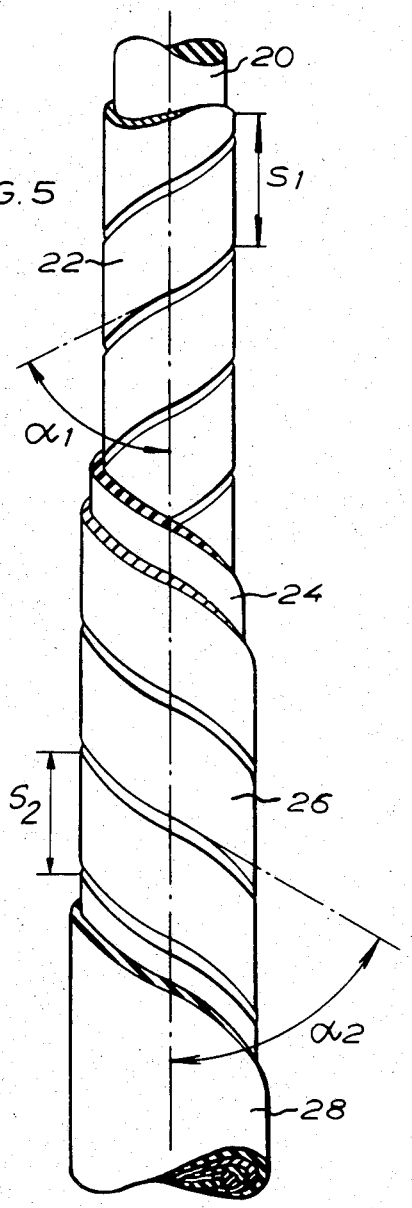
FIG. 5 shows another embodiment of a rope according to the invention.

As will appear from FIG. 5 the rope according to the invention can have two different reinforcing layers. The rope according to FIG. 5 thus has a core 20, an inner reinforcement 22 in the form of a helically wound cord string or cord strip. On the outer side of said inner reinforcement 22 is placed an intermediate rubber 24 and on the other side of said intermediate rubber an outer reinforcement 26. Finally, an outer sheath 28 is disposed outside the reinforcements. In FIG. 5, the inner reinforcement is helically wound in one direction while the outer reinforcement 26 is helically wound in the other direction. The reinforcement angle of the inner reinforcement is designated $\alpha_1$ and its pitch $s_1$. The reinforcement angle of the outer reinforcement is designated $\alpha_2$ and its pitch $s_2$.

Figure 2:
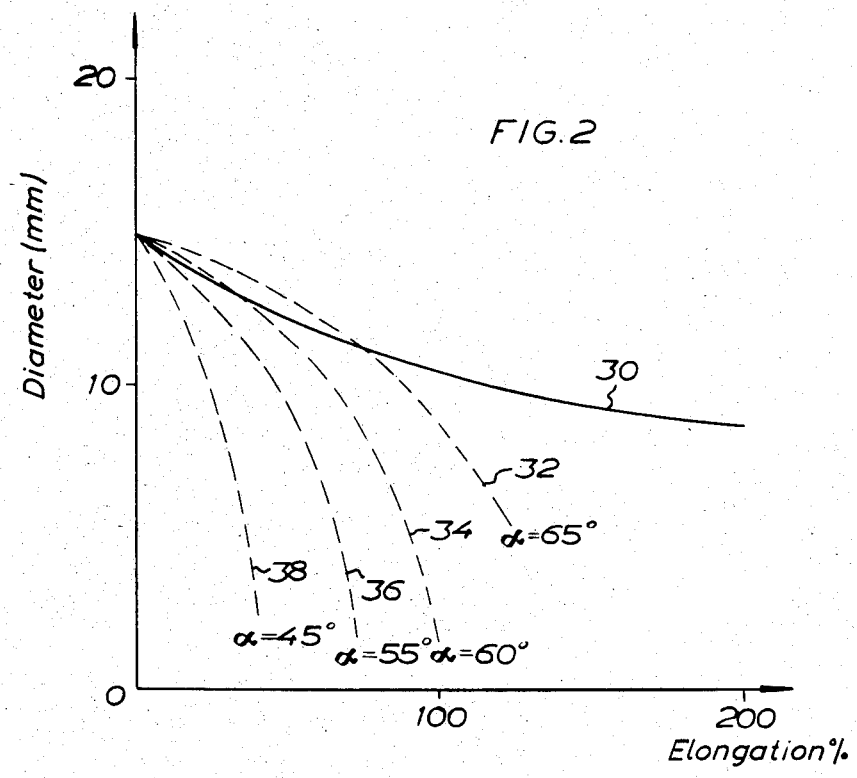
FIG. 2 shows a diagram elucidating the relative diameter changes of the core and reinforcement of the rope.

FIG. 2 is a diagram showing how the diameters of the core and a helically wound cord strip change on elongation. The curves are theoretically calculated. The full line 30 shows how the original diameter 15 mm changes on elongation of the core by 200%. The broken line 32 indicates the change in diameter of a helical reinforcement the reinforcement angle of which is 65°. Similarly, the broken curves 34, 36 and 38 show the changes in diameter of reinforcements with the reinforcement angles 60°, 55° and 45°, respectively. It will appear from the theoretically calculated diagram that the reinforcement angle $\alpha$ greatly influences when the helically wound reinforcement shall prevail and thus start producing the aimed-at progressivity in the rope. At the reinforcement angle $\alpha=65°$ the diameter of the reinforcement helix will be smaller than that of the core only after about 75% elongation. For a reinforcement with the reinforcement angle $\alpha=60°$ elongation must first take place to about 30% before the reinforcement helix begins having a smaller diameter than the elongated core. As regards reinforcements with reinforcement angles $\alpha=45°$ and $\alpha=55°$, the decrease in diameter of the reinforcement helix is from the very beginning larger than the decrease in diameter of the elastomer core as such. After a study of FIG. 2 one would thus expect a curve showing the elongation as a function of the load to extend relatively rectilinearly up to about 20–30% elongation when the reinforcement angle is $\alpha=60°$, and up to about 75% when the reinforcement angle is $\alpha=65°$.

Figure 3:
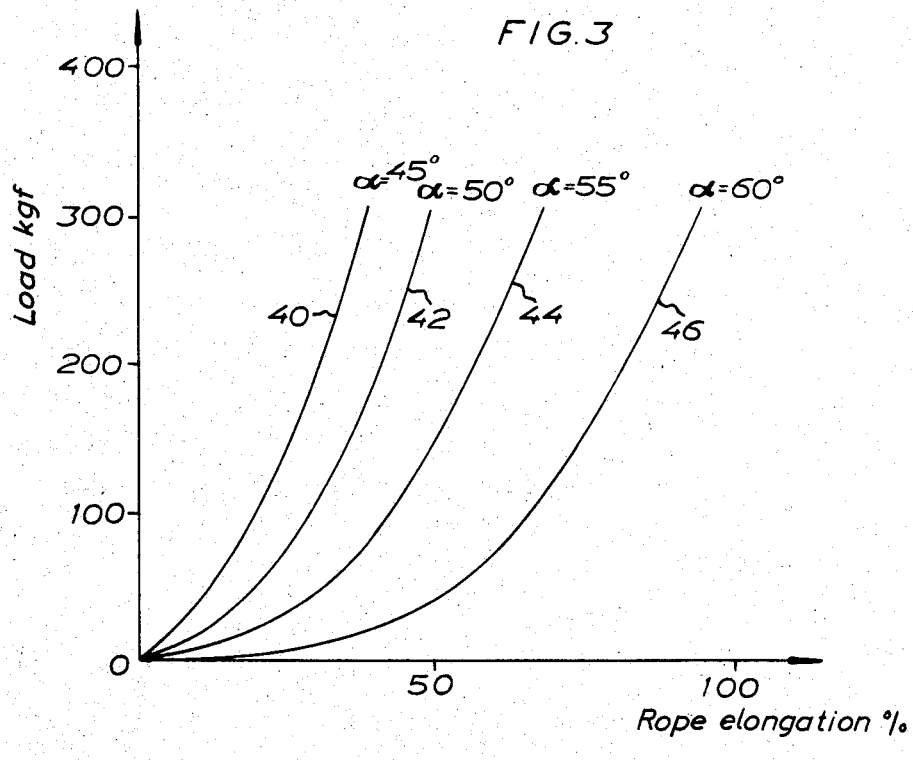
FIG. 3 shows theoretically calculated curves of how various ropes are elongated at increasing load.

FIG. 3 shows theoretically calculated curves indicating how different ropes are elongated at increasing load. The calculations are based on a structure with a core consisting of styrene butadiene rubber of hardness 75° IRH and having a diameter of 15 mm. The helically wound reinforcement consists of 24 parallel polyester cord strings (1100×2) and has been wound with the indicated reinforcement angles $\alpha$, the number of polyester cord strings per reinforcement pitch turn thus being 24. The different turns of polyester cord strings are wound closely adjoining. The curves 40, 42, 44, 46 show the elongation of the elastomer rope with reinforcement angles of 45°, 50°, 55° and 60°, respectively. These curves confirm that which has been stated above with reference to FIG. 2, viz. that the reinforcement gives a progressivity in the resistance of the ropes to increased elongation.

Figure 4:
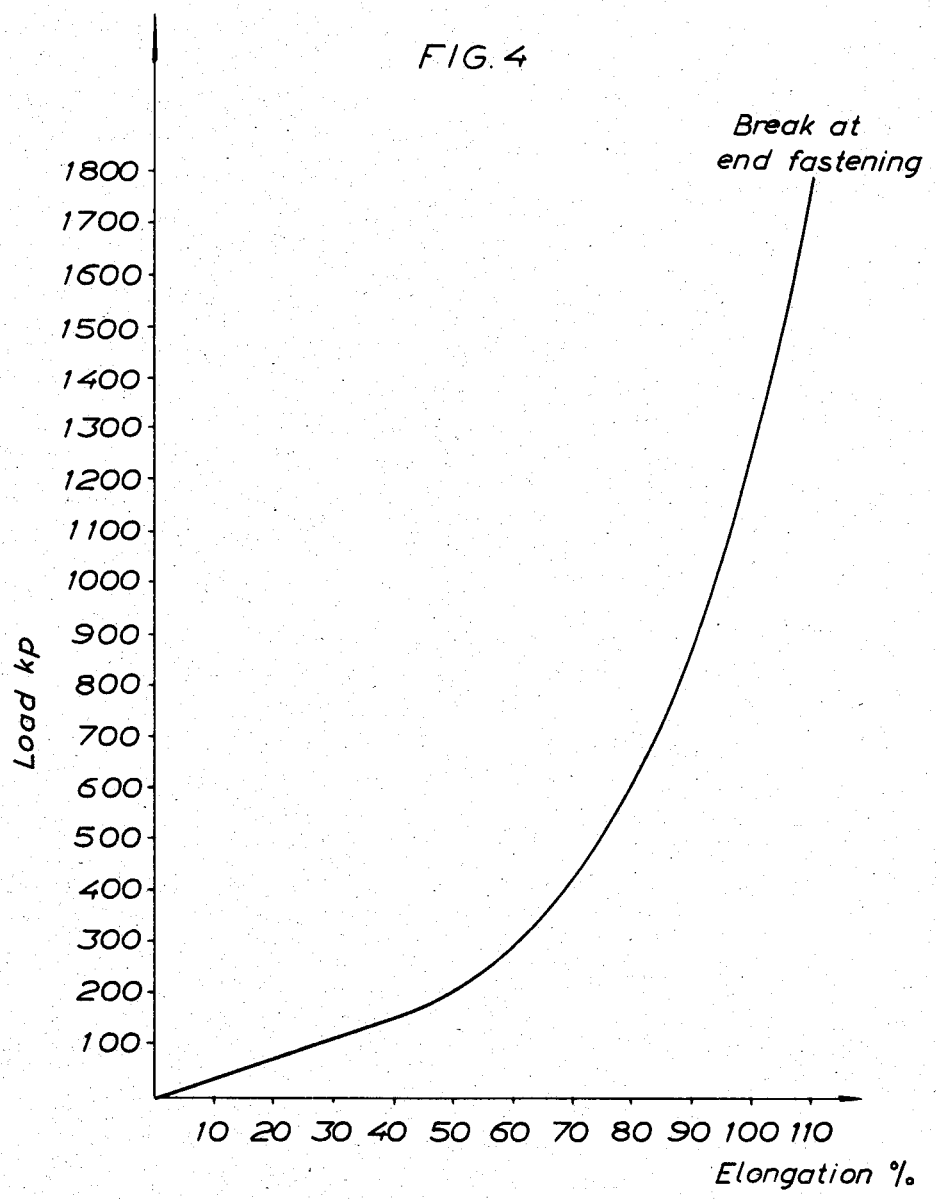
FIG. 4 shows a diagram of how the elongation depends on the load in the embodiment of the rope illustrated in FIG. 1.

FIG. 4 shows an example of the ratio of load to elongation in a rope which has been manufactured manually and given the structure shown in FIG. 1. In this case the rubber core 10 had a diameter of about 20 mm and a hardness of about 50° Shore. On the outer side of the rubber core 10 there had been wound a polyester strip, four plies in thickness and having a width of 8 mm, the gap between two successive turns being 2 mm. The pitch s of the reinforcement thus was 10 mm. It can be established from FIG. 4 that the elongation curve extends relatively rectilinearly until about 45% elongation has resulted. Then progressivity begins, and progressivity increases the more the greater the elongation.

Figure 6:
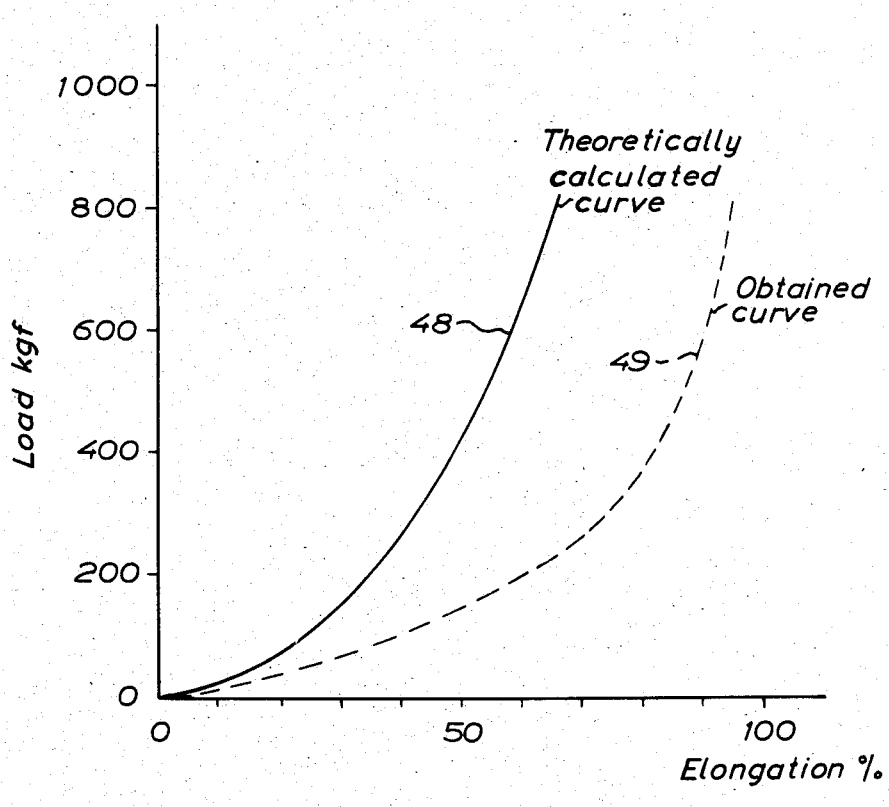
FIG. 6 shows how the elongation depends on the load of a rope illustrated in FIG. 5.

FIG. 6 shows a curve illustrating how the elongation depends on the loading force when the rope is of the construction shown in FIG. 5. The theoretically calculated curve 48 is shown by a full line. The established curve 49 is shown by a broken line. The rope was composed of a solid core which had a diameter of 15 mm and consisted of styrene butadiene rubber and had a hardness of 50° Shore. The inner reinforcement consisted of polyester cord strips which were applied under a reinforcement angle $\alpha_1=56°$ and a pitch $s_1=31.3$ mm. The rubber interlayer was a styrene butadiene rubber having a thickness of 0.38 mm. A further reinforcing layer which was applied under a reinforcement angle $\alpha_2=57.2°$ and a pitch $s_2=32.2$ mm, was disposed on the other side of the rubber interlayer. The reason why the theoretically calculated curve differs from the curve obtained is that the theoretical calculations did not take into consideration all factors influencing the change in diameter of the two reinforcing layers when these layers were stretched in the longitudinal sense of the rope. The outer sheath 28 of this rope consisted of EPDM rubber.

Figure 7:
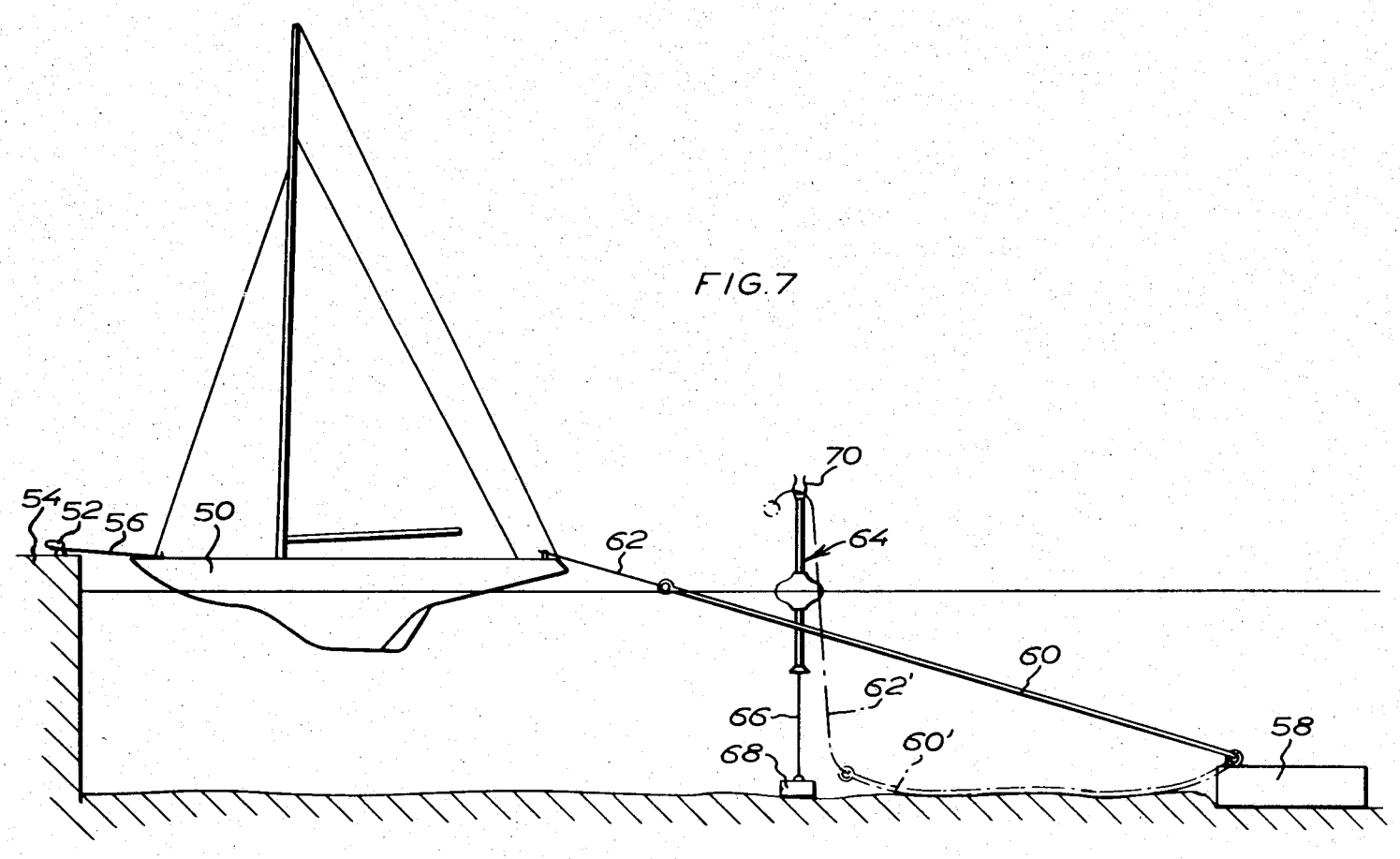
FIG. 7 shows an embodiment of a mooring device in which a rope according to the present invention is utilized.

FIG. 7 shows an embodiment of a mooring device in which use is made of the elastomer rope described in the foregoing. As will appear from the figure, a pleasure boat 50 is anchored in conventional manner to a bollard 52 on a quay 54 by means of a rope 56. An anchorage stone 58 lies on the bottom of the marina basin at a great distance from the quay 54. Said stone 58 lies on the usual place where anchorage buoys are at present placed in marina basins. An elastomer rope 60 is fixed to the anchorage stone. Said elastomer rope may be of the construction illustrated in FIG. 1 or FIG. 5. The elastomer rope has its other end connected to an ordinary rope, e.g. a polyester rope 62. With the aid of the rope 62 and a hand winch on the boat 50 the elastomer line 60 has been stretched to such an extent that the requisite pull exists in the anchorage hawser consisting of the elastomer rope and the polyester rope. Although the elastomer rope is thus kept stretched the hawser still has the possibility of further elongation on changes in water level or the like.

A suspension buoy 64 lies close to the stern of the boat. This buoy 64 is anchored by means of an elastic element 66 to a buoy stone 68, and the buoy has at its upper end a fork 70. The preferred construction of the buoy 64 is shown in FIG. 8.

The buoy 64 is thus placed considerably closer to the quay 54 than what is normally the case for buoys in marinas. Normally, the buoys are placed above the anchorage stone 58. The suspension buoy 64 serves to keep hold of the polyester rope attached to the elastomer rope when the anchorage device is not utilized. As will appear from FIG. 8 the elastomer rope 60' in this position has assumed its slackened length which is considerably shorter than the length of the elastomer rope 60 when it is stretched for mooring of the boat 50. The elastomer rope 60 being capable of heavily shortening its length the bottom of the marina basin will not be covered with long winding lengths of hawsers.

The great advantages gained with a mooring or anchoring device according to the invention, in which an elastomer rope 60 is utilized, will be realized from a study of FIG. 7. A considerably larger free space is thus obtained outside the suspension buoys, for which reason the manoeuvrability in the marina basin is essentially increased. Another advantage resides in that the elastomer rope 60 by its elasticity will be able to keep the boat 50 in the correct position straight outwardly from the quay 54 and also yield to a certain extent at changes in water level.

Figure 8:
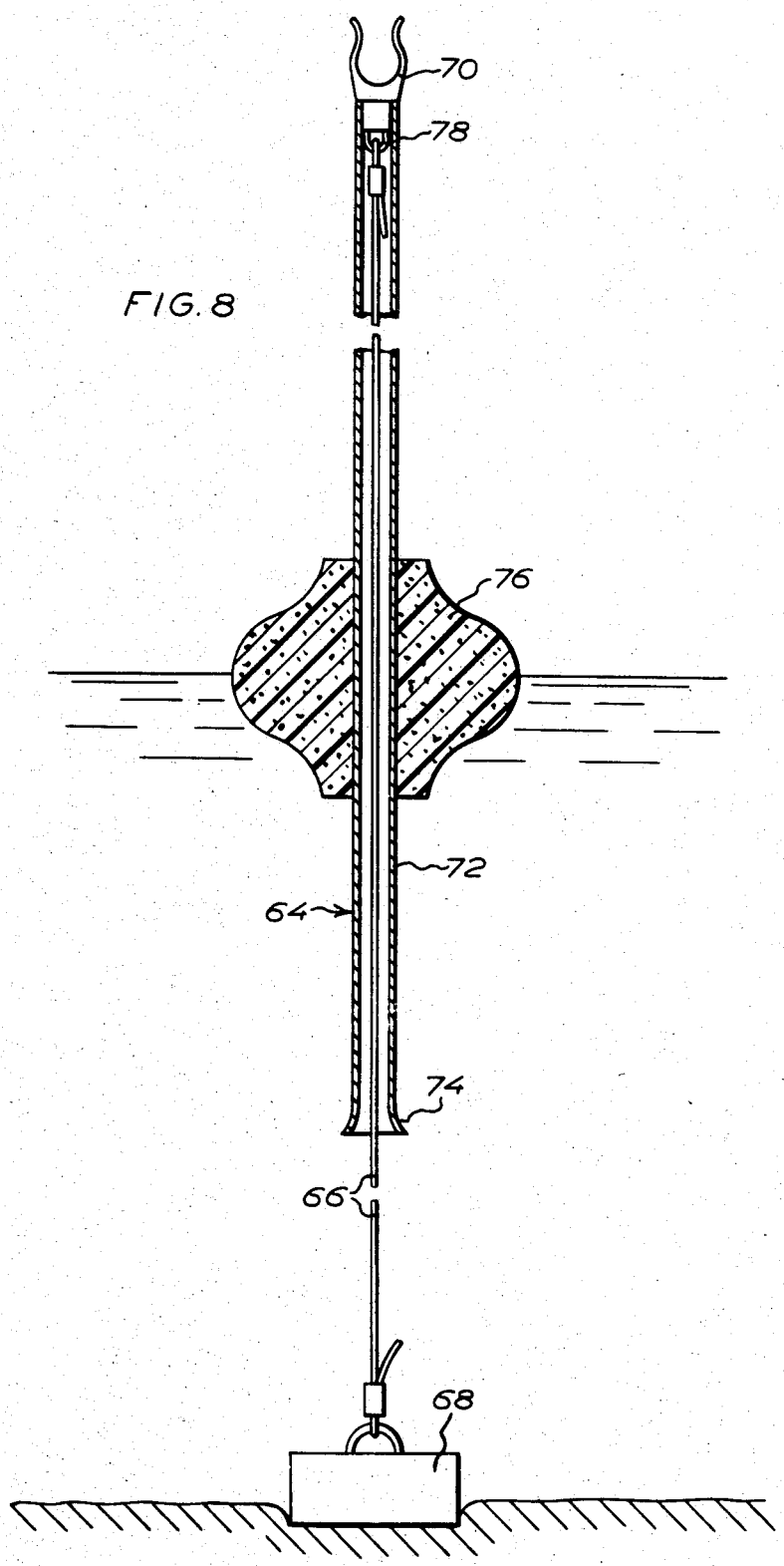
FIG. 8 shows an embodiment of a buoy which has been anchored with a mooring device according to the invention.

FIG. 8 shows the suspension buoy 64 in greater detail. As will appear from this figure, the buoy has a tube 72 which is flared at its lower end at 74. The tube 72 extends a considerable distance downwards from the floating body 76 of the buoy and also upstands above the floating body up to the suspension fork 70 which is pushed down into the end of the tube 72 and has a fastening lug 78 in which the elastomer rope 66 is tied. The elastomer rope 66 is prestressed so that the floating body 76 is halfway above the water surface at normal water level. As the elastomer rope 66 extends all the way from the buoy stone 68 to the upper end of the tube 72 an extra long length of the elastomer rope is obtained, whereby the percental extension or shortening of the elastomer rope at changes in water level will not be so large. The elastomer rope 66 can be a conventional EPDM cord but it is most advantageous if the elastomer rope is formed as an elastomer rope of the nature described with reference to FIG. 1 or FIG. 5. For as a result hereof the tendency of the buoy to drift laterally will be considerably reduced because said elastomer rope has a progressive action and thus necessitates a progressively greater force for elongation.

The buoy shown in FIGS. 7 and 8 can also be utilized as a marker buoy or navigation mark, in which case the fork 70 is replaced by a suitable top sign.

Figure 9:
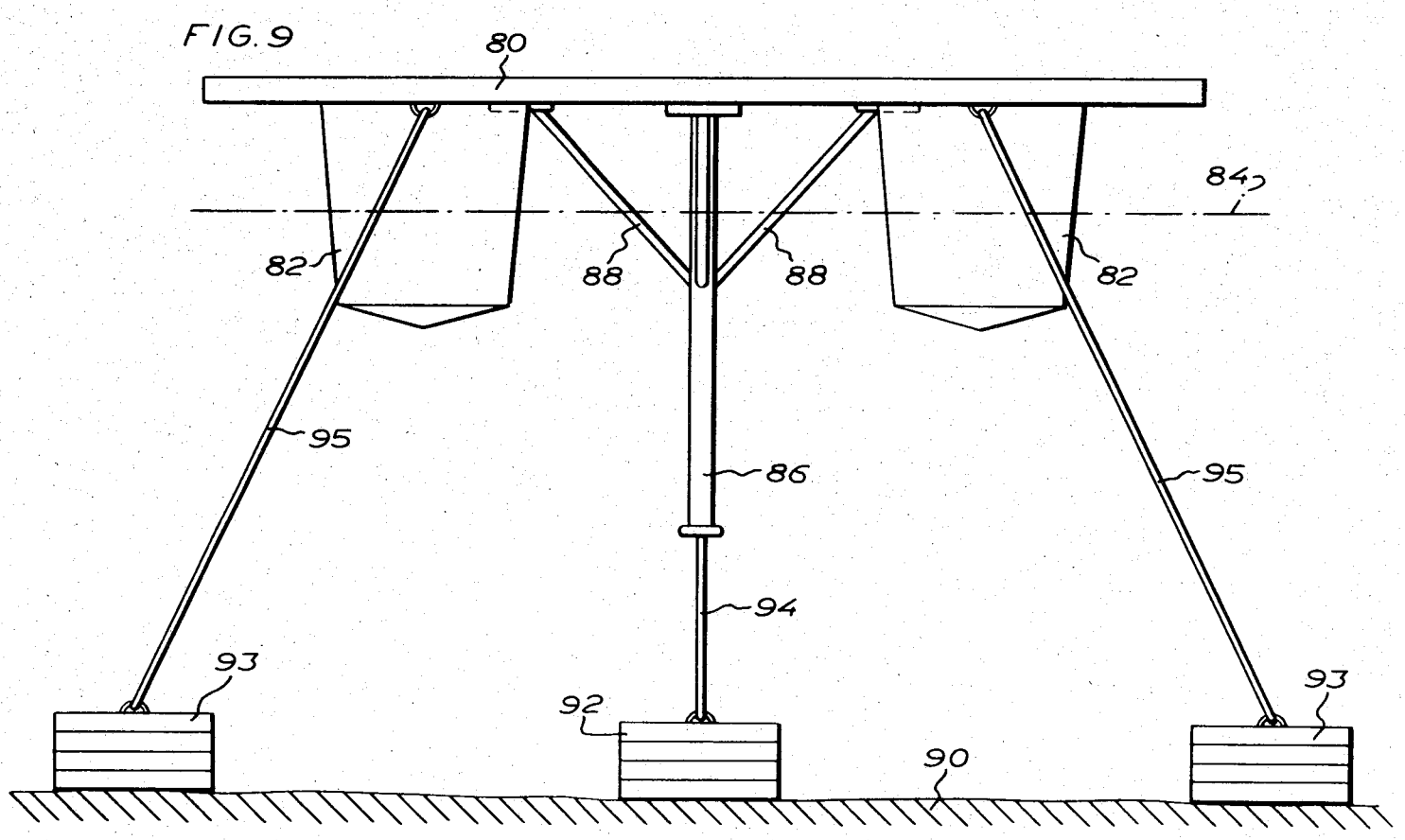
FIG. 9 shows an embodiment of a mooring device according to the invention for use with a floating landing stage.

FIG. 9 shows an example how to utilize the mooring device according to the invention for mooring a floating landing stage 80. Said landing stage has two rows of floating bodies 82 and so great a displacement that they are normally only halfway immersed in the water, as is illustrated by the water line 84. Between the two rows of floating bodies 82 there is a downwardly extending tubular arm 86 which fundamentally is of the same design as the tube 72 in FIG. 8. The tube 86 is united by means of stays 88 with the underside of the floating landing stage 80. A buoy stone 92 is placed on the sea bottom 90. An elastic element 94 is fixed to said buoy stone. The elastic element 94 extends upwards through the tube 86 and is fixed to the upper end thereof (this is not shown but is fundamentally in accordance with what is shown in FIG. 8). The tube 86 preferably extends so far below the landing stage 80 that the distance between the sea bottom 90 and the lower end of the tube is approximately a third of the distance between the bottom 90 and the underside of the landing stage 80.

The landing stage is anchored by placing the anchorage or buoy stone 92 centrally beneath the position where the centre line of the landing stage is meant to lie. The elastic element 94 is secured in a suitable way in the anchorage 92. The landing stage is placed straight above the anchorage and the elastic element 94 is passed upwards through the tubular arm 86 to the upper side of the landing stage 80. Then the element 94 is stretched to such a high extent that the landing stage 80 is prestressed towards the water surface even if the lowest conceivable water level should prevail, and the element 94 is then made fast to the landing stage. By this arrangement the floating bodies 82 which are of light weight but of great displacement will be lowered somewhat and thus increase their buoyancy and, as a consequence, also increase the lateral stability of the floating landing stage 80.

In addition to the latter property which implies that the floating landing stage need not be loaded with weights to increase lateral stability, there is obtained because of the tubular arm 86 a rigid moment arm the lower end of which tends, when the loading stage 80 is subject to lateral load, to move substantially horizontally. However, this tendency is counteracted in such a case by the elastic element 94, and said element, as a consequence, contributes to further increasing the lateral stability of the loading stage. This lateral stability can be still further increased, if the elastic element 94, as is preferred, is formed by an elastomer rope of the nature indicated with reference to FIGS. 1–6, having progressive characteristics.

Each loading stage can be composed of a number of coupled sections, in which case only the first and the last section need be provided with such centrally placed anchoring devices according to the invention. With a large number of sections, it is, however, suitable to utilize several different anchoring devices.

Figure 10:
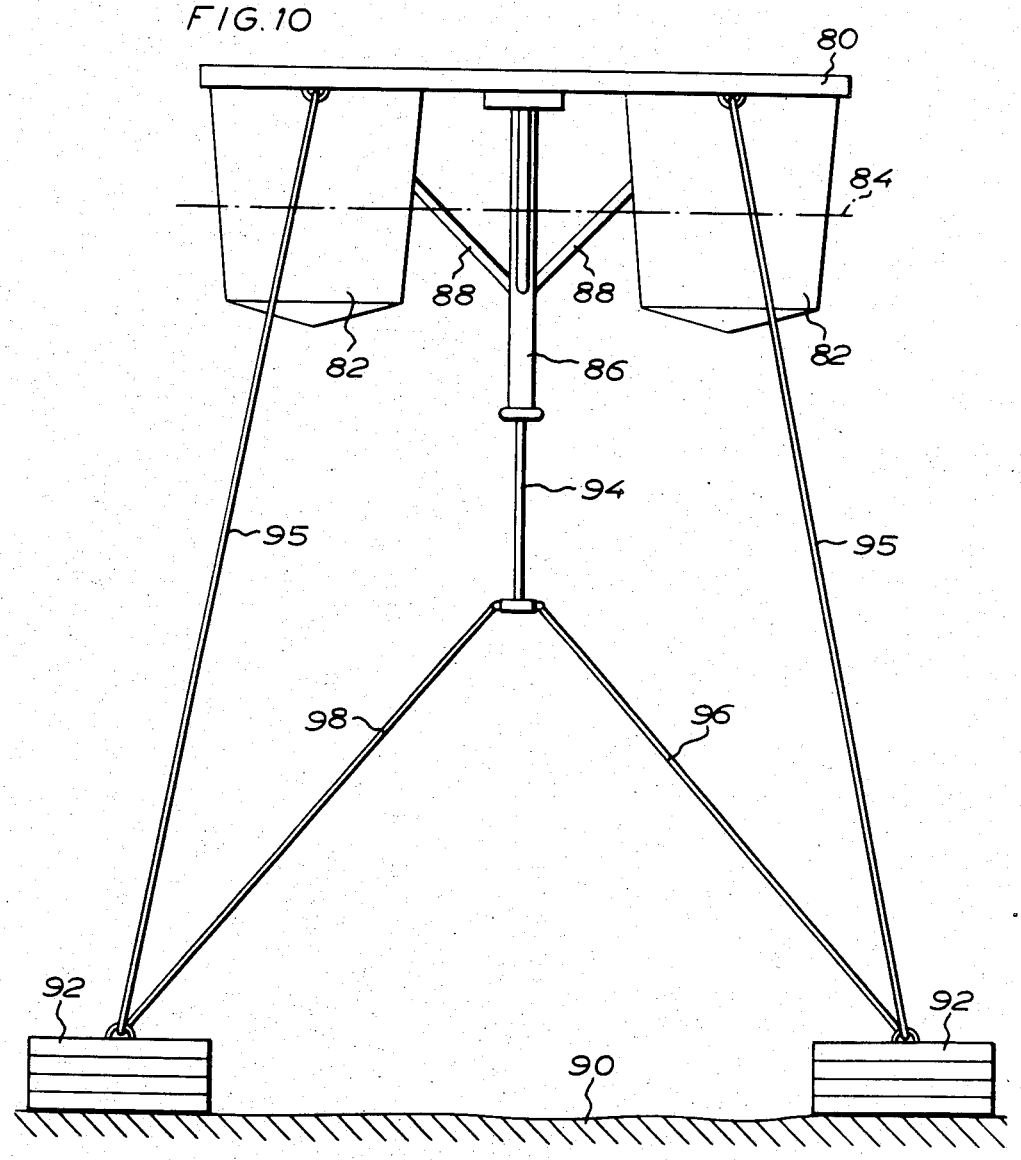
FIG. 10 shows another embodiment of said mooring device.

FIG. 10 shows another embodiment of the device illustrated in FIG. 9, the only difference being that the elastic element 94 is not directly anchored to one buoy stone, but has been anchored to two buoy stones with the aid of ropes 96, 98. This embodiment is particularly advantageous when floating landing stages are anchored in deep parts.

What I claim and desire to secure by Letters Patent is:

1. A mooring device for anchoring floating landing stages, buoys, navigation marks and the like, comprising two floating bodies of relatively great displacement, and means connecting each of said floating bodies to one or more stationary anchorages placed on the sea bottom, wherein said means comprises a rigid tubular arm which is rigidly connected to the floating bodies by stays and projects downwardly from said bodies, said two floating bodies being placed on either side of said arm, an elastomer rope being connected to at least one stationary anchorage and extending into and through said tubular arm and being attached to the upper end thereof, wherein said rope has a core of elastomeric material, a fiber reinforcement disposed around said core, and an outer covering layer of elastomeric material, said elastomeric material in said core and said covering layer comprising synthetic rubber, wherein the fiber reinforcement comprises two strip layers of a material considerably less elongatable than the elastomeric material of said core, which strip layers are helically wound about the core in opposite directions, each with a reinforcement angle of 50°–65° between the longitudinal axis of the rope and the reinforcement projected at right angles thereto, and wherein said strip layers are separated from each other by a continuous layer of elastomeric material.

2. A mooring device as claimed in claim 1, wherein the length of the arm under water considerably exceeds the distance between said anchorages and the lower end of said arm.

3. A mooring device for anchoring floating landing stages, buoys, navigation marks and the like, comprising two floating bodies (76, 82) of relatively great displacement, and means (66, 72, 94–98) connecting each of said floating bodies to one or more stationary anchorages (68, 92) placed on the sea bottom, said means (66, 72, 94–98) comprising a rigid tubular arm (72, 86) which is rigidly connected to the floating bodies (76, 82) by stay means (88) and projects downwardly from said bodies, said two floating bodies being placed on either side of said arm (86), an elastic element (66, 94), comprising an elastomer rope being connected to the stationary anchorage or anchorages (68, 92) and extending into and through said tubular arm (72) and being attached to the upper end thereof, and the elastic element (66, 94) being preferably stretched and under tensile stress, said elastomer rope comprising a core of elastomeric material, a reinforcement disposed around said core, and an outer covering layer of elastomeric material, said elastomeric material in said core and said covering layer comprising synthetic rubber, wherein the reinforcement comprises two layers of a material considerably less elongatable than the elastomeric material of said core, which layers are helically wound about the core in opposite directions, each with a reinforcement angle of 50°–65° between the longitudinal axis of the rope and the reinforcement projected at right angles thereto.

* * * * *